US007354147B2

(12) United States Patent
Beehler

(10) Patent No.: US 7,354,147 B2
(45) Date of Patent: Apr. 8, 2008

(54) PLATEN HAVING CHANNELS AND METHOD FOR THE SAME

(75) Inventor: James O. Beehler, Brush Prarie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 210 days.

(21) Appl. No.: 10/701,787

(22) Filed: Nov. 4, 2003

(65) Prior Publication Data

US 2005/0095046 A1 May 5, 2005

(51) Int. Cl.
*B41J 2/01* (2006.01)

(52) U.S. Cl. ..... 347/104; 347/101

(58) Field of Classification Search ..... 347/104, 347/101; 400/23, 48, 648, 656
See application file for complete search history.

(56) References Cited

U.S. PATENT DOCUMENTS 6,209,867 B1 * 4/2001 Madsen et al. ..... 271/276
6,247,861 B1 6/2001 Wotton
6,254,081 B1 7/2001 Rasmussen et al.
6,254,090 B1 7/2001 Rhodes et al.
6,254,092 B1 7/2001 Yraceburu et al.
6,328,491 B1 12/2001 Beehler et al.
6,454,259 B1 9/2002 Madsen et al.
6,497,522 B2 12/2002 Wotton et al.
2002/0047885 A1 * 4/2002 Miyawaki et al. ..... 347/104
2003/0085980 A1 * 5/2003 Ishii et al. ..... 347/104

FOREIGN PATENT DOCUMENTS

JP 08156351 A * 6/1996

* cited by examiner

*Primary Examiner*—Manish S. Shah

(57) ABSTRACT

A method and apparatus providing a platen for supporting a media sheet. The platen includes a contact surface, a channel and air passage. The channel is defined in the contact surface and includes a varying cross-sectional area along at least a portion of a length of the channel. The air passage extends from the channel to deliver negative pressure to the channel. The depth of the channel at the second end is less than the depth of the channel at the first end, and the width of the channel at the first end is greater than the width of the channel at second end.

25 Claims, 10 Drawing Sheets

PLATEN HAVING CHANNELS AND METHOD FOR THE SAME

BACKGROUND

Printing devices typically include a vacuum platen for suctioning a media sheet to a platen to stabilize the sheet while printing. One common configuration for a vacuum platen includes apertures or perforations in a surface of the platen through which an air flow is established by a vacuum source. The environment in the area of a print zone is often full of printing composition, aerosol and spray, as well as print medium dust and other types of debris. Over time, the apertures of the vacuum platen may fill and partially or completely clog with such debris. Such clogging reduces the airflow, thereby decreasing the securing force holding the media sheet against the vacuum platen. In some cases, the apertures in the vacuum platen may fill with enough debris so that the air flow is substantially reduced or eliminated, resulting in insufficient or no suctioning force for holding the media sheet to the vacuum platen. In such cases, the printing device effectively becomes inoperable. Further, any of the apertures uncovered by the media sheet results in loss of vacuum pressure and often requires a higher powered vacuum to maintain sufficient suction to the media sheet. Such pressure loss often results in insufficient pressure to hold the edge of the media sheet to the platen.

BRIEF DESCRIPTION OF THE DRAWINGS

While the specification concludes with claims particularly pointing out and distinctly claiming that which is regarded as the present invention, the advantages of this invention may be ascertained from the following description of the invention when read in conjunction with the accompanying drawings, in which:

FIG. 10(*b*) illustrates a perspective view of another embodiment of the cylindrical drum platen with channels defined in the contact surface of the drum platen and extending laterally with respect to the longitudinal length of the drum platen;

DETAILED DESCRIPTION

Figure 1:
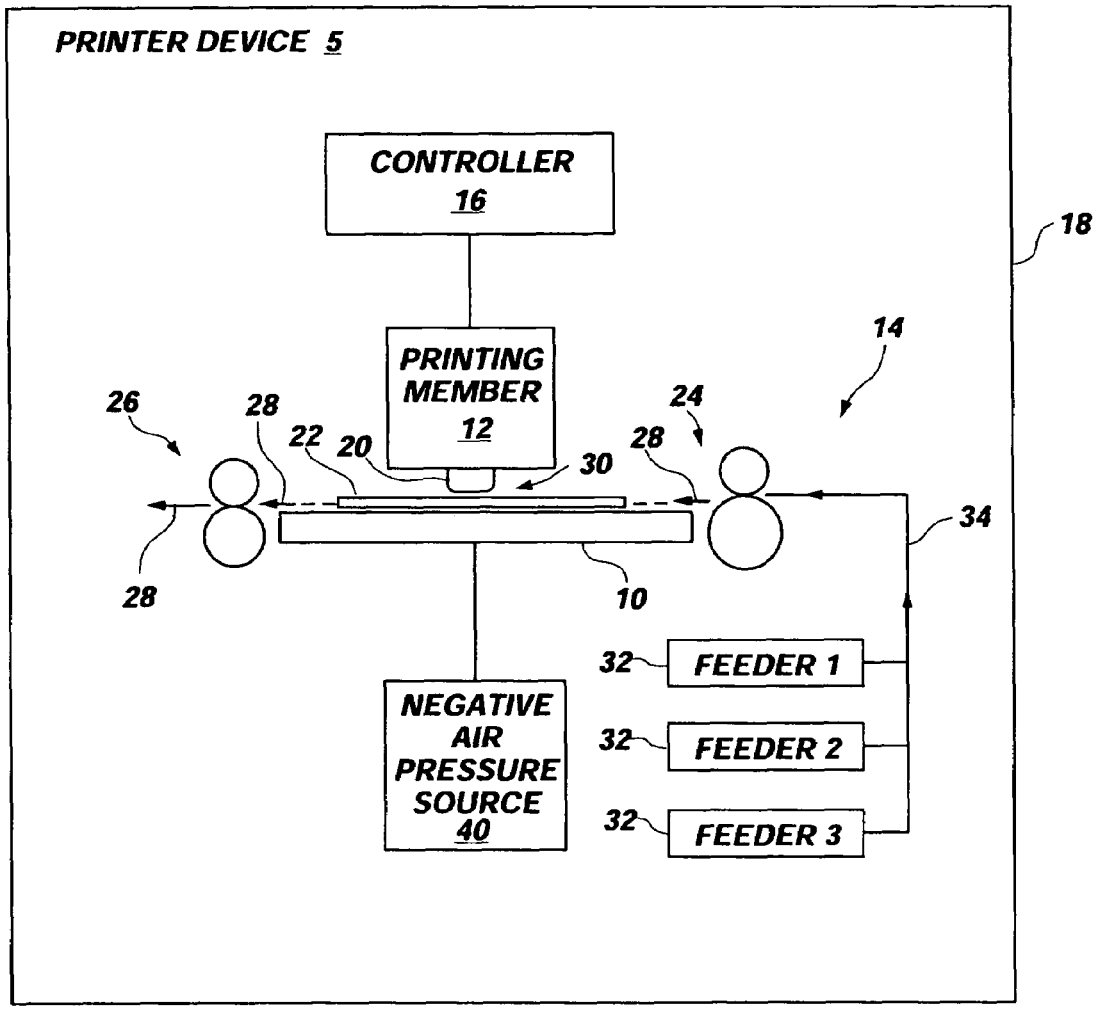
FIG. 1 illustrates a schematic diagram of a printer apparatus and various components thereof, depicting the printer apparatus having a media holding device operatively coupled to a negative air pressure source configured to suction a media sheet to the media holding device for printing thereto, according to an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

FIG. 1 is a simplified schematic diagram of a printer device 5 having a media holding device 10 disposed therein in accordance with an embodiment of the present invention. Such a printer device 5 can be utilized for various aspects of printing, such as, printing business reports, correspondence, desktop publishing, and the like. The media holding device 10 of the present invention can be embodied in various types of printer devices including printers, plotters, copiers, and facsimile machines, to name a few, as well as various combination devices, such as combination facsimiles and printers. In addition, the media holding device 10 of the present invention may be used in a variety of types of printer devices such as inkjet printers, dot matrix printers, laser printers, and the like.

The printer device 5 typically includes, among other things, a printing member 12, a transport system 14 a controller 16 and the media holding device 10 each housed within a casing 18. The printing member 12 can include a print head 20 configured for ink-jet printing. In another embodiment, the printing member 12 may comprise a print engine configured for laser printing, and/or dot matrix printing, and/or any other suitable type of printing. Such a print head 20 is operable to print an image onto a medium, such as a media sheet 22, within a print zone 30. The media sheet 22 can include any suitable medium for printing on, such as paper, transparencies, photo paper, etc. and can be in the form of individual sheets and/or a continuous roll in any suitable dimension as known in the art.

The controller 16 is used to process, compute and control the formation of images on the media sheet 22 through the printing member 12. The controller 16 typically receives instructions from a host device, typically a host computer, such as a remote personal computer (not shown). Many of the functions of the controller 16 may be implemented through the host device, such as printer drivers located on the host device, to electrically communicate with the controller 16.

The transport system 14 can include various rollers and/or belts configured to transport one or more media sheets 22 to the media holding device 10. Such a transport system 14 can include, for example, input pinch rollers 24 and output pinch rollers 26 to transport the media sheet 22 to the media holding device 10 as well as transport the media sheet 22 from the media holding device 10. Such input and output pinch rollers 24 and 26 can be selectively driven and controlled by the controller 16 and one or more motors and drive gears (not shown) to selectively and controllably transport one or more media sheets 22 to and from the media holding device 10 as indicated by arrows 28.

The media holding device 10 is operatively coupled to a negative air pressure source 40. Such negative air pressure source 40 delivers negative air pressure and establishes air flow through a plurality of air passages (not shown) extending through the media holding device 10. As the transport system 14 transports the media sheet 22 to the media holding device 10, the back surface of the media sheet 22 is controllably held in position against the media holding device 10 with a suction force to facilitate printing with the print head 20, or other print engine, on the front surface of the media sheet 22. The media holding device 10 will be discussed in further detail below in reference to the remaining drawings.

The transport system 14 also includes a plurality of media feeders 32 with feed paths 34 for transporting the media sheet 22 to the print zone 30. Such feeders 32 each include a tray configured to contain individual media sheets and/or a rack to hold a media sheet roll. The feed path can include rollers and/or belts or any other suitable means for transporting the media sheet 22 to the print zone 30. The media feeders 32 can each be separately configured to hold various sized media sheets or can be configured to hold a fixed sized media sheet. The controller 16 can also be coupled to each of feeders 32 and/or feed path 34 to control selective transport of the media sheet 22 from any one of the feeders 32 to the print zone 30. In some alternative embodiments, a single feeder 32 is sufficient. Other suitable numbers of feeders 32 may optionally be employed.

Figure 2:
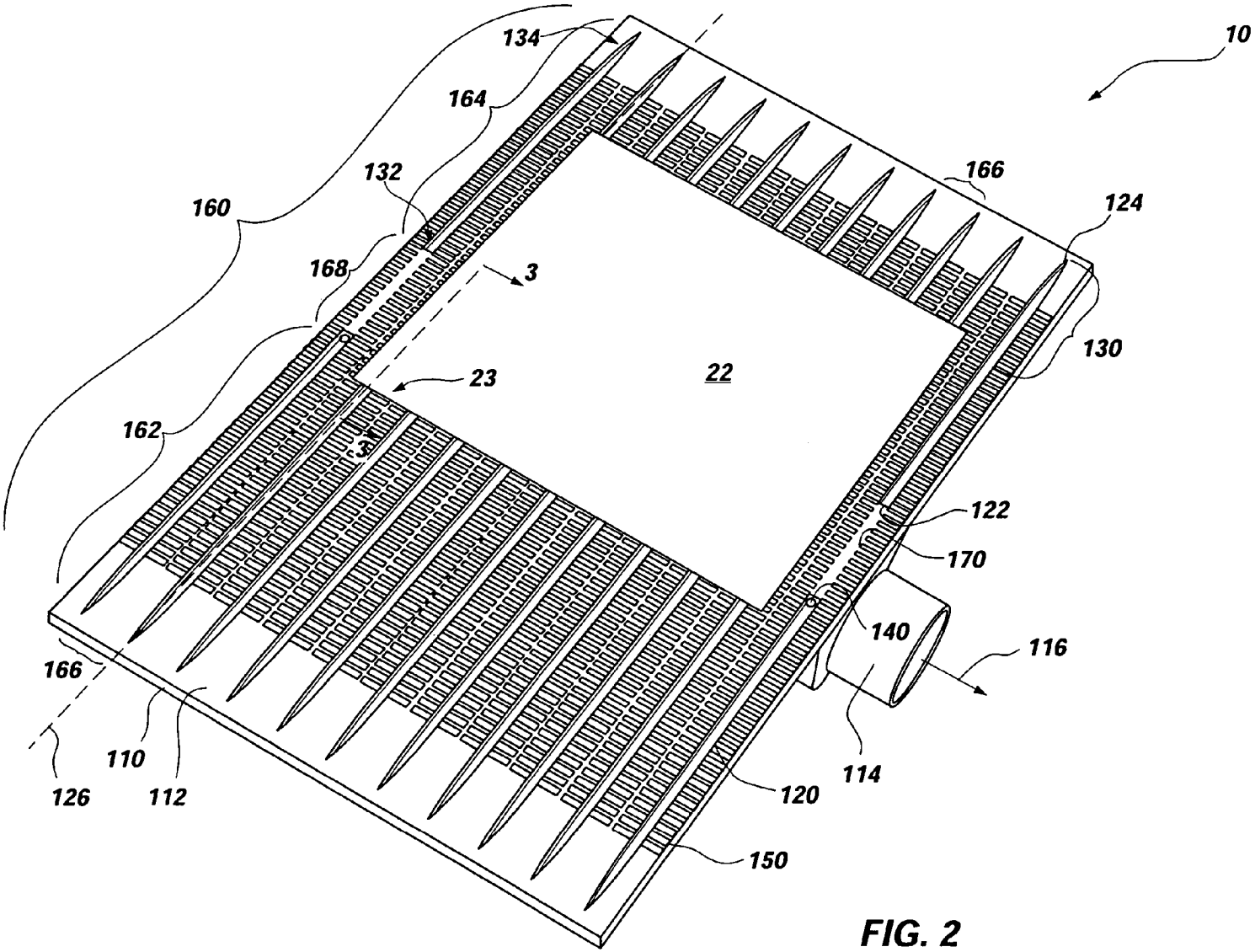
FIG. 2 illustrates a perspective view of the media holding device illustrated in FIG. 1, depicting the media holding device having an array configuration defined in a platen including a plurality of channels with elongated recesses extending laterally therefrom, according to an embodiment of the present invention.
Figure 3:
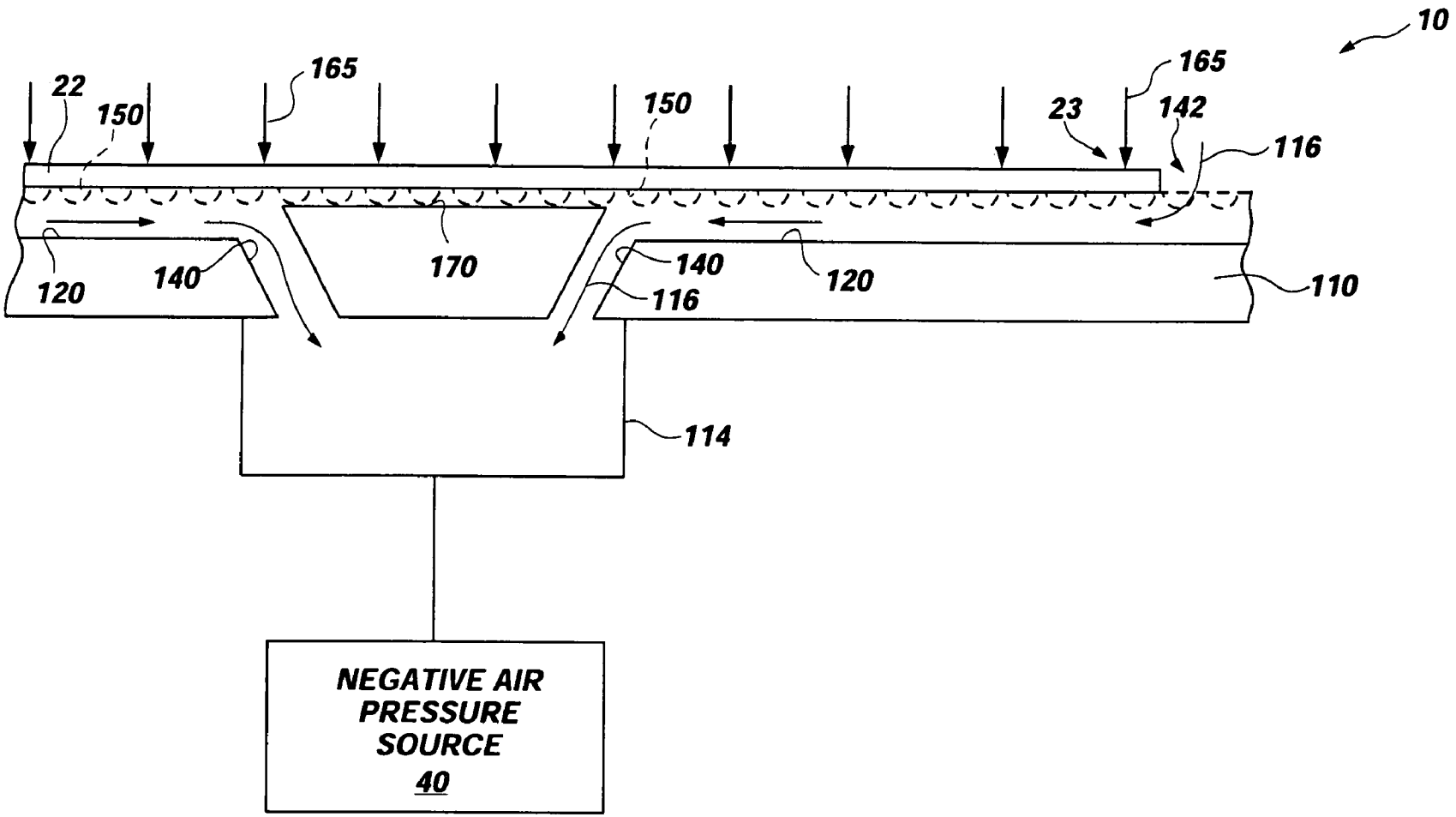
FIG. 3 illustrates a partial cross-sectional side view of the media holding device taken along line 3 in FIG. 2, depicting the channels operatively coupled to a negative air pressure source configured to provide air flow through the channels operable to provide a suction force to the media sheet.

FIGS. 2 and 3 illustrate an embodiment of the media holding device 10 configured to receive and suction the media sheet 22 for printing. Such a media holding device 10 can include a platen 110 having a contact surface 112 configured to receive a back surface of the media sheet thereon. In one embodiment, the contact surface 112 of the platen 110 can be a substantially planar surface. In another embodiment, the platen 110 can be a cylindrical drum platen. The media holding device 10 can be formed from any known suitable material or combinations thereof, such as metals, polymeric materials, resins, glass-type materials, composites, or the like.

The platen 110 includes a plurality of channels 120 defined, or formed, in the contact surface 112 with opposite first and second ends 122 and 124. The platen 110 also includes a plurality of air passages 140 defined therein and extending through the platen 110. The air passages 140, defined with opposite open ends, can be disposed between an air duct 114 and a portion of the channels 120. Such air passages 140 are operable to provide air flow 116 through the channels 120 via the negative air pressure source 40 operatively coupled thereto.

The channels 120 can be formed in an array configuration 160 that can include a first array 162 of channels 120 extending substantially parallel with respect to each other and a second array 164 of channels 120 extending substantially parallel with respect to each other. The channels 120 in the first array 162 can extend and taper oppositely with respect to the channels 120 in the second array 164 with an array gap 168 defined between the first and second arrays 162 and 164. Further, a channel gap 166 is defined between each of the channels 120 in each of the first and second arrays 162 and 164. Each of the channels 120 can include a longitudinal axis 126 so that the longitudinal axis 126 for each of the channels 120 in the first array 162 substantially corresponds and is common to one of each of the channels 120 in the second array 164.

Each of the channels 120 can include a proximal portion 132 and a distal portion 134 at the respective first and second ends 122 and 124 of the channel 120. The channels 120 can include a varying cross-sectional area along at least a portion of the length of each of the channels 120. As can be well appreciated by one of ordinary skill in the art, varying the cross-sectional area along a portion of the length of the channel can be employed with many types of structure. In one embodiment, each of the channels 120 can include a tapered portion 130 extending at least partially along a longitudinal length of the channel 120 and configured to taper toward the distal portion 134 thereof. The tapered portion 130 can taper by varying a depth of the channel 120 and by varying a width of the channel 120, or both. As such, the tapered portion 130 can initially taper at the proximal portion 132 or at any portion along the longitudinal length distal to the proximal portion 132. With this arrangement, the proximal portion 132 of the channel 120 can include a channel cross-sectional area that is greater than the channel cross-sectional area of the distal portion 134 of the channel 120. Further each channel 120 can include at least one of the air passages 140 at the proximal portion 132 thereof to facilitate air flow 116 through the channels 120 via the negative air pressure source 140. With this arrangement, the air flow 116 is channeled downstream along the length of the channel covered by the media sheet toward the air passage 140 in the channel 120.

The contact surface 112 of the platen 110 can also include elongated recesses 150 defined therein and extending laterally from opposing sides of each of the channels 120 and into the channel gap 166 between the substantially parallel channels 120. The elongated recesses 150 can be configured to be shallow in comparison to a depth of the channels 120. Such elongated recesses 150 also provide suction to the media sheet 22 since the elongated recesses 150 are exposed to the air flow 116 and negative air pressure in the channels 120. In this manner, the elongated recesses 150 act in conjunction with the channels 120 to facilitate suction to the back surface of the media sheet 22 when the media sheet is positioned on the contact surface 112 of the platen 110.

Further, within the array gap 168 between the first array 162 and second array 164, a shallow channel 170 can interconnect and longitudinally extend between corresponding channels 120 having a common longitudinal axis 126. Such a shallow channel 170 can be defined between the at least one air passage 140 at the proximal portion 132 of each of the channels 120 having the common longitudinal axis 126. Also, additional elongated recesses 150 can extend laterally from the shallow channel 170 defined in the contact surface 112 within the array gap 168. The shallow channel 170 can include a depth defined in the contact surface 112 substantially the same as the depth of the elongated recesses 150 defined in the contact surface 112. With this arrangement, each of the channels 120, elongated recesses 150 and the shallow channels 170 defined in the contact surface 112 of the platen 110 collectively define the array configuration 160 with an area which can be sized and configured to be larger than a periphery of the media sheet 22.

The channels 120 in the array configuration can be configured to suction the media sheet to the contact surface with a suction force 165 that can be substantially uniform across the media sheet 22 and/or provide a sufficient suction force 165 to an edge portion 23 of the media sheet 22 and across the media sheet 22. With the media sheet 22 positioned over the contact surface 112, the negative air pressure source 40 establishes the air flow 116 within the channels from an exposed portion 142 of the channels. Such an exposed portion 142 can be a portion, such as the distal portion 134, of the channel that is not covered by the media sheet 22.

The suction force 165 applied at the edge portion 23 and across the media sheet 22 is obtained by the configuration of the channels 120. Consistent with Bernoulli's equation, if airflow is frictionless, static pressure along an air passage will be lowest where the velocity of the airflow is the greatest. This effect causes the static pressure within the channel 120 to be at a minimum at the edge of the media sheet and also increases the suction force 165 applied to the edge portion 23 of the media sheet 22. Under Bernoulli's theory, since the cross sectional area of the channels 120 is smallest at the edge portion 23 of the media sheet 22, the velocity of the air flow 116 through the channels 120 is also the greatest at the edge portion 23 of the media sheet 22 and decreases down stream as the cross-sectional area of the channel 120 increases. Further, as the cross-sectional area of the channel 120 increases down stream in the channel 120, the velocity of the air flow 116 decreases causing the static pressure within the channel 120 to increase and the suction force 165 applied to the media sheet 22 to decrease as the point of observation is moved downstream toward the air passage 140. However, friction is present, causing static air pressure within the channel to decrease and the suction force 165 to increase as the point of observation is moved downstream. As such, by adjusting the rate at which the channel cross-sectional area is reduced, the suction force 165 obtained can be manipulated so that the suction force 165 at the edge portion 23 of the media sheet 22 can be as great or greater than the suction force 165 provided along the remaining length of the channel 120 toward the air passage 140 and applied across the media sheet 23.

Furthermore, friction loss can be reduced by tilting and sizing the air passages 140. In particular, the air passages 140 can be tilted to reduce the directional change of the air flow 116 and sized to have a substantially similar cross-sectional area as that of the channel cross-sectional area at the proximal portion 132 of the channels 120. In this manner, the effect on the air flow 116 can be reduced during the transition between the channels 120 and the air passages 140 to, thereby, reduce the pressure drop as the air flow 116 passes through the air passages 140. Also, with the air passages 140 sized with a cross-sectional area similar to the channel cross-sectional area, the potential for debris clogging the air passages 140 can be substantially reduced.

Figure 4:
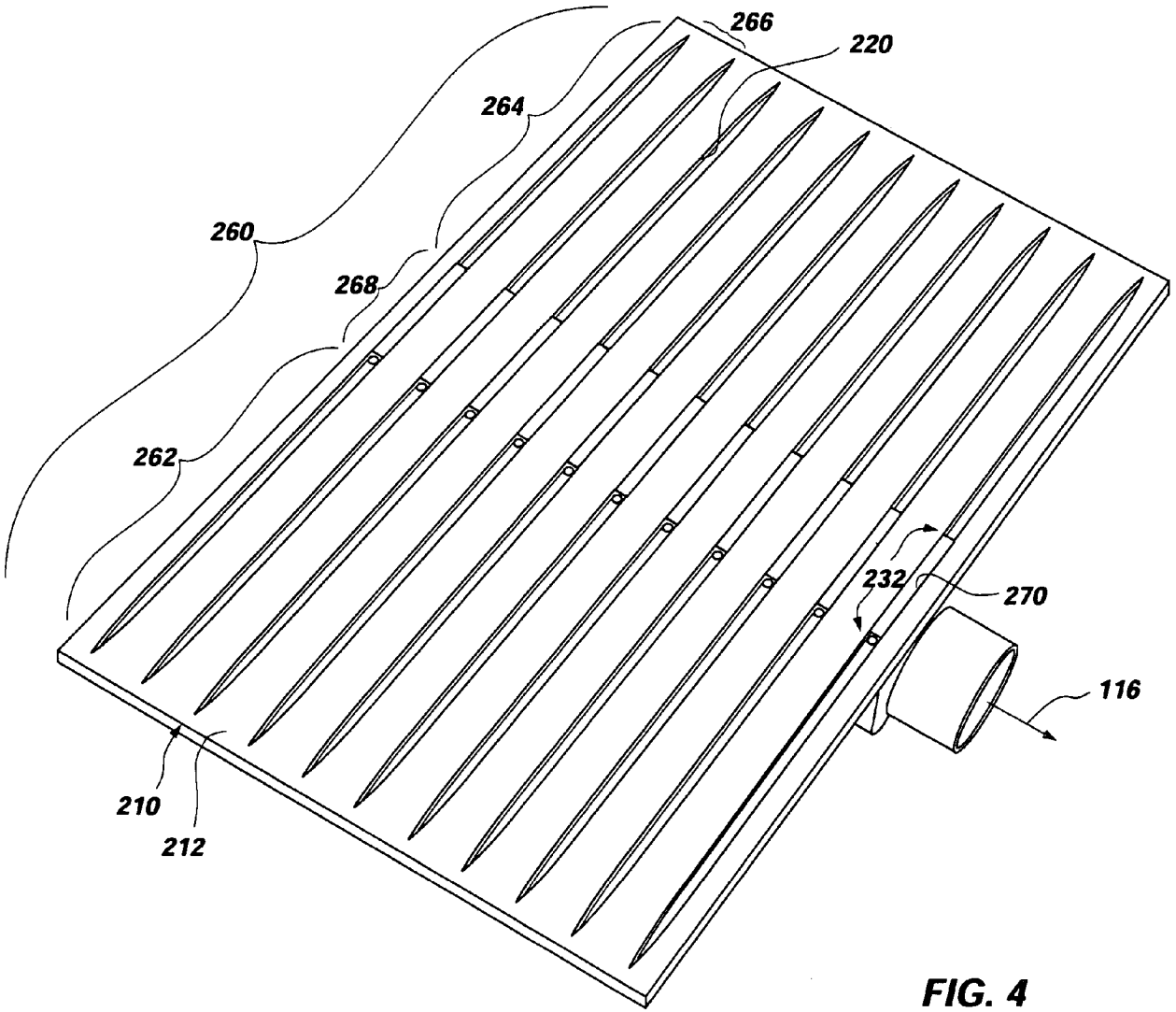
FIG. 4 illustrates a perspective view of another embodiment of an array configuration defined in the platen, depicting the platen having a plurality of channels formed in the platen without the elongated recesses.

With respect to FIG. 4, another embodiment of a platen 210 is illustrated. In this embodiment, the platen 210 is substantially the same as the previous embodiment, except the platen 210 does not include the elongated recesses. As in the previous embodiment, the channels 220 defined in the contact surface 212 of the platen 210 include the first array 262 and the second array 264 to form, at least partially, the array configuration 260. In this embodiment, the channel gap 266 defining the spacing between each of the channels 220 can be smaller than the spacing between the channel in the previous embodiment. Such channel gap 266 can be sized of sufficient spacing to provide the suction necessary through the channels 220 and, thus, applied to the media sheet (not shown) as can be determined by one of ordinary skill in the art.

As in the previous embodiment, the channels 220 of the first and second arrays 262 and 264 can include a varying cross-sectional area along a portion of the length of each channel. In particular, the channels 220 of the first array 262 can taper oppositely with respect to the channels 220 of the second array 264 with the array gap 268 defined on the contact surface 212 between the channels 220 of the first and second array 262 and 264. The contact surface 212 can also include the shallow channels 270 defined in the array gap 268 extending between the proximal portion 132 of corresponding channels 220 in the first and second array 262 and 264. With this arrangement, the array configuration 260 includes the first and second arrays 262 and 264 of channels 220 with the shallow channels 270 interconnecting the channels 220 of the first and second arrays 262 and 264.

Figure 5:
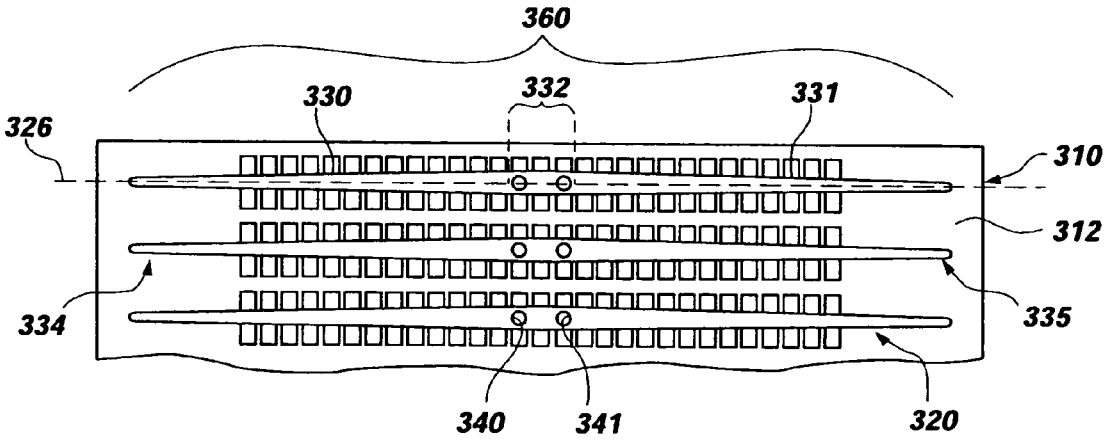
FIG. 5 illustrates a partial top view of another embodiment of an array configuration defined in the platen, depicting the channels each having two tapered portions tapering in opposite directions.
Figure 6:
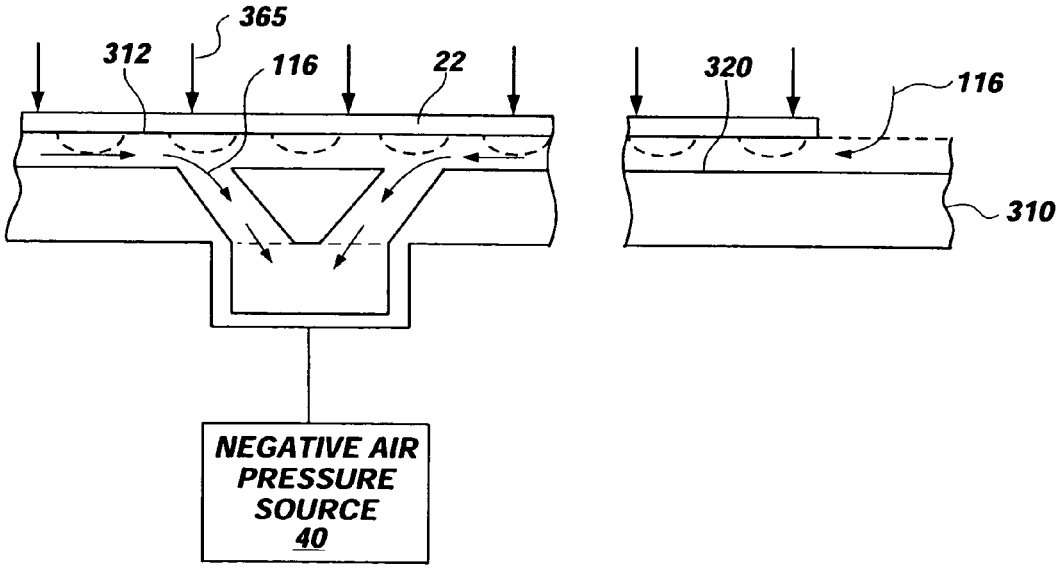
FIG. 6 illustrates a partial cross-sectional side view of the platen in FIG. 5 taken along the longitudinal axis of one of the channels, depicting the channels operatively coupled to the negative air pressure source with a media sheet suctioned to the platen.

Referring now to FIGS. 5 and 6, another embodiment of an array configuration 360 of channels 320 defined in the platen 310 is illustrated. This embodiment is similar to the embodiment described with respect to FIGS. 2 and 3, except the shallow channel 170 of the previous embodiment is defined with a depth of the opposing channels to form a single channel 320 with two tapered portions tapering in opposite directions. The array configuration 360 can include a column of the channels 320 with each channel 320 spaced in the contact surface 312 and longitudinally extending substantially parallel with respect to each other and their longitudinal axes 326. Each channel 320 can include a first distal end portion 334 and a second distal end portion 335 with a proximal middle portion 332 defined therebetween. Each channel 320 also can include a first tapered portion 330 and a second tapered portion 331 each respectively tapering in opposite directions from the proximal middle portion 332 distally toward the first and second distal end portions 334 and 335. Further, each channel 320 can include a first air passage 340 and a second air passage 341 each disposed in the proximal middle portion 332 of the channel 320. The first and second air passages 340 and 341 are operable to deliver negative air pressure within the channel 320 and along the respective first and second tapered portions 330 and 331 of the channel 320. In this manner, the first and second air passages 340 and 341 can provide an air flow 316 from the respective first and second distal end portions 334 and 335 to the proximal middle portion 332 through the respective first and second air passages 340 and 341.

As in the previous embodiment, the channels 320 in the array configuration 360 facilitate a suction force at the edge portion of the media sheet and over the media sheet. Such suction force is operable to sufficiently maintain the media sheet in a substantially planar configuration for printing. Further, the first and second air passages 340 and 341 disposed in the proximal middle portion of the channels 320 can be sized to substantially prevent clogging the air passages with debris.

Figure 7:
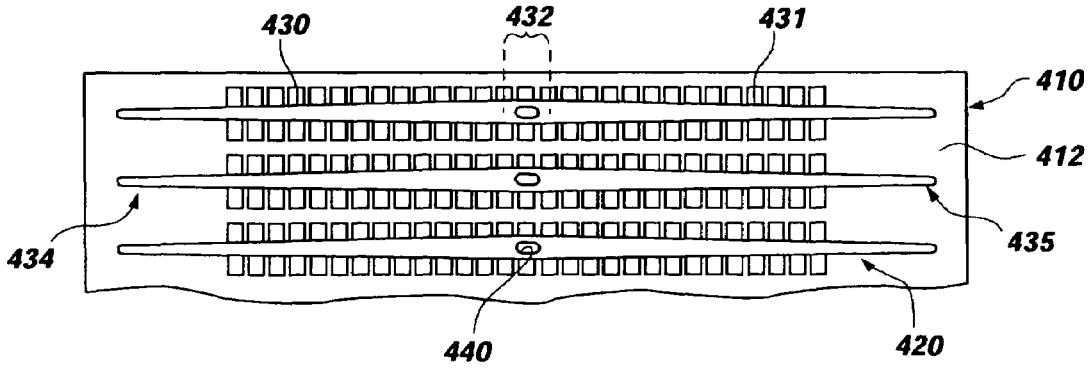
FIG. 7 illustrates a partial top view of another embodiment of an array configuration defined in the platen, depicting the channels each having two tapered portions tapering in opposite directions with a single air passage for each channel.
Figure 8:
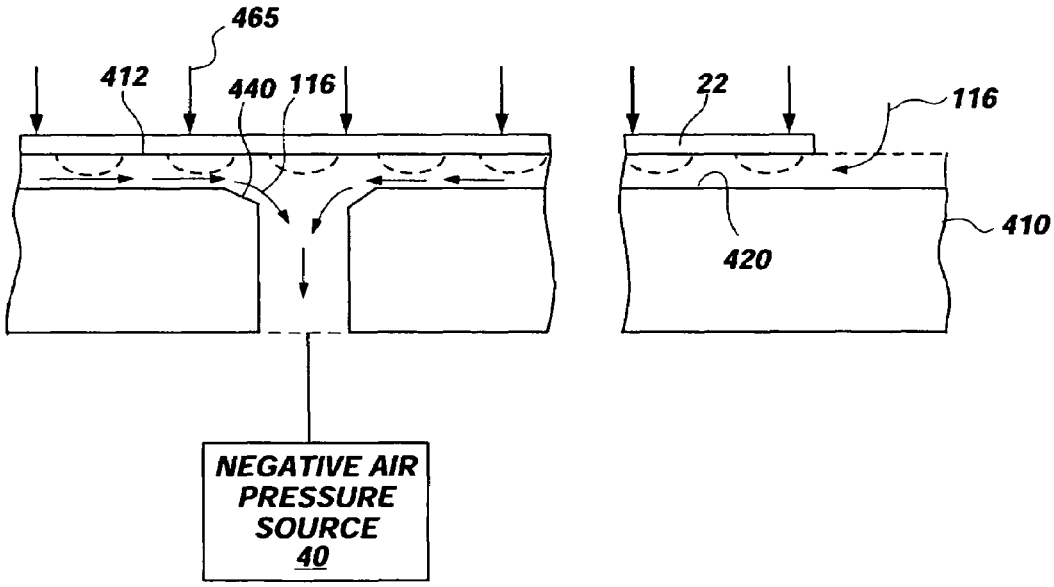
FIG. 8 illustrates a partial cross-sectional side view of the platen in FIG. 7 taken along the longitudinal axis of one of the channels, depicting the channels operatively coupled to a negative air pressure source with the single air passage for each channel.

FIGS. 7 and 8 illustrate another embodiment of channels 420 defined in the contact surface 412 of the platen 410. In this embodiment, the channels 420 are substantially the same as in the previous embodiment described in FIGS. 5 and 6, except in this embodiment each channel 420 includes a single air passage 440. This air passage 440 can be positioned in the proximal middle portion 432 for each of the channels 420 and can be configured and sized to provide air flow 416 through opposing directions of the channel within and between first and second distal end portions 434 and 435 of the channels 420. As in the previous embodiments, the first and second tapered portions 430 and 431 of this embodiment also facilitate a suction force 465 to the edge portion 23 of the media sheet 22 and across the media sheet 22.

Figure 9:
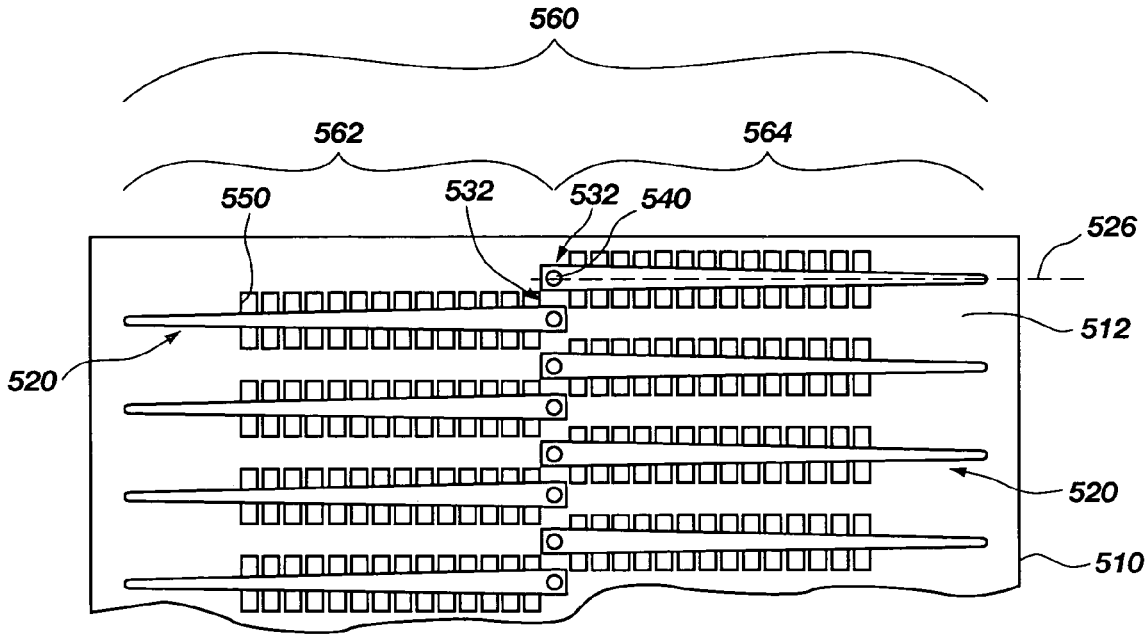
FIG. 9 illustrates a top view of another embodiment of an array configuration defined in the platen, depicting the channels of a first and second array staggered and tapering oppositely with respect to each other.

With respect to FIG. 9, in another embodiment, the channels 520 of the first and second arrays 562 and 564 defined in the contact surface 512 of the platen 510 can be in a staggered configuration with the longitudinal axis 526 for each of the channels 520 extending substantially parallel with respect to each other. Such staggered channels 520 can extend so that the proximal portions 532 of the channels 520 in the first array 562 overlap with and/or are adjacent to adjacent ones of the proximal portion 532 of the channels 520 in the second array 564. Likewise, openings for the air passages 540 disposed at the proximal portion 532 of the channels 520 of the first array 562 can be aligned with or stager with the openings of the air passages 540 disposed at the proximal portion 532 of the channels 520 of the second array 564. The array configuration 560 in this embodiment can also include the elongated recesses 550 extending laterally from each of the channels 520.

Figure 10A:
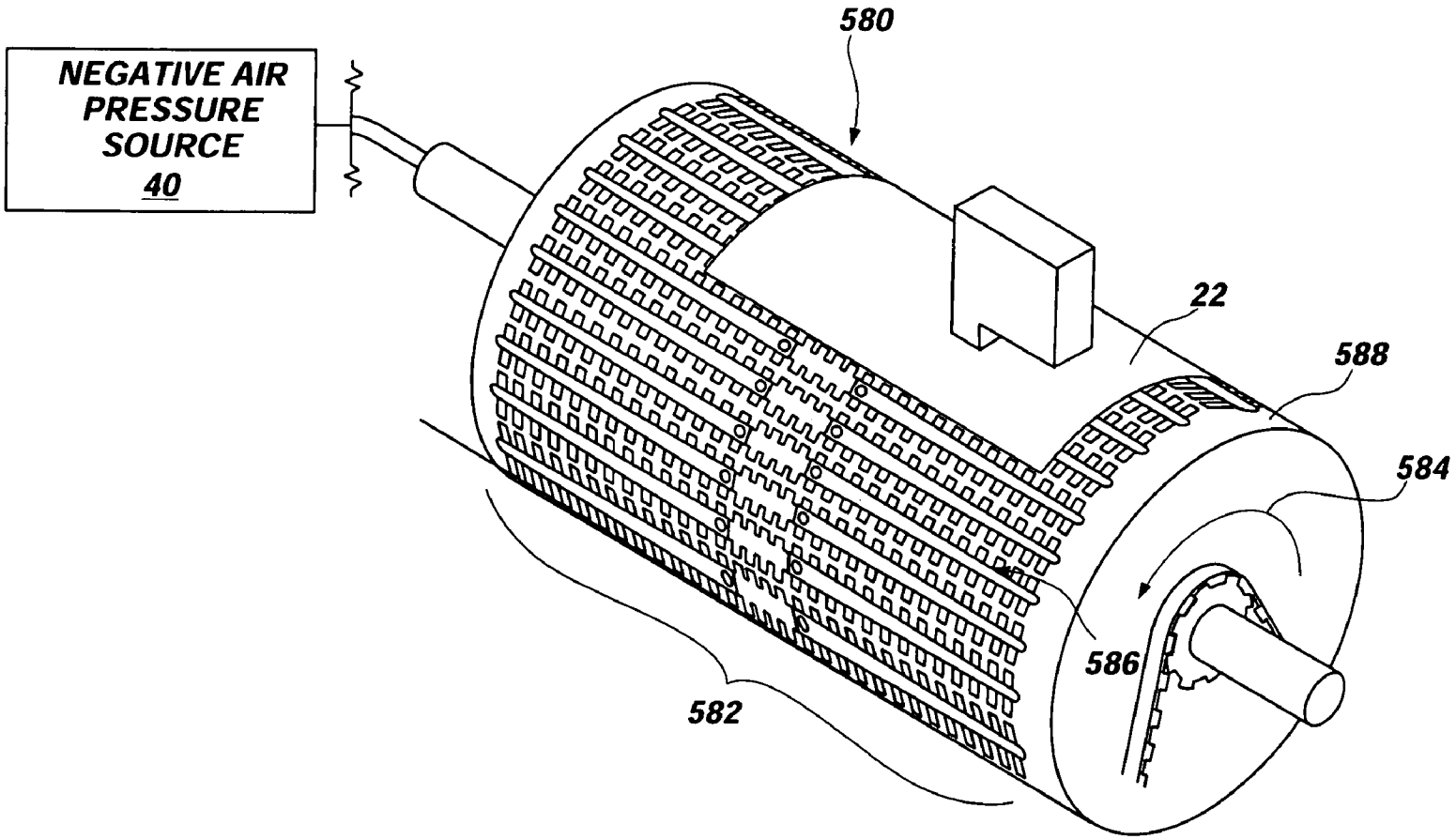
FIG. 10(*a*) illustrates a perspective view of another embodiment of the media holding device, depicting the platen configured as a cylindrical drum platen with channels extending longitudinally in the contact surface of the drum platen along a longitudinal length thereof.
Figure 10B:
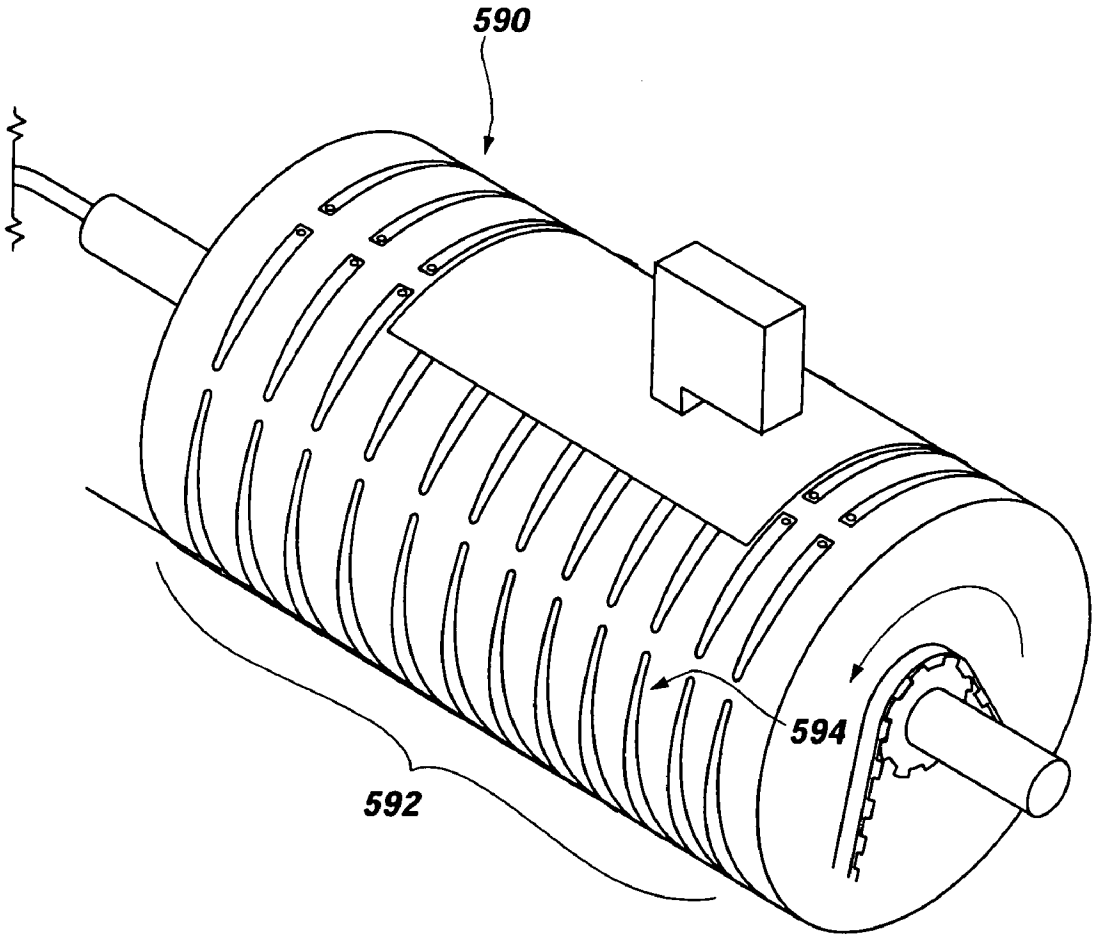

FIG. 10(*a*) illustrates another embodiment of the platen sized and configured as a cylindrical drum platen 580. The drum platen 580 can include one or more array configurations 582 to hold one or more media sheets 22 thereon at a time. The drum platen 580 can be rotated, as indicated by arrow 584, by one or more motors and gears (not shown). The drum platen 580 includes a negative air pressure source 40 operatively coupled thereto, wherein the negative air pressure source 40 can be located remotely with respect to the drum platen 580 or can be located within the drum platen 580. As such, the negative air pressure source 40 provides air flow through the channels 586, as in the previous embodiments. In this embodiment, the channels 586 can extend parallel to each other in the contact surface 588 of the drum platen 580 along a longitudinal length thereof. Further, each of the channels 586 can include a varying cross-sectional area along at least a portion of the length of the channels 586.

With reference to FIG. 10(*a*), in another embodiment, the drum platen 590 can include one or more array configurations 592 with the channels 594 extending curvilinearly around the drum platen 590 and laterally with respect to the longitudinal length of the drum platen 590. As can be well appreciated by one of ordinary skill in the art, the array configuration implemented in the drum platen depicted in FIGS:. 10(*a*) and 10(*b*) can be any suitable array configuration with any suitable channel described herein or any other suitable array configuration with channels.

Figure 11A:
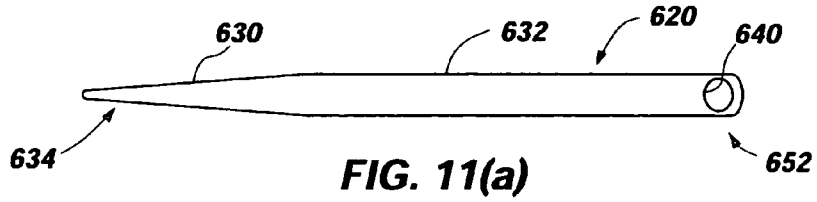
FIGS. 11(*a*) and 11(*b*) illustrate respective top and side profile views of a tapered channel, depicting the tapered channel having a non-tapered constant portion and a tapered portion tapering in width and depth of the tapered channel, according to an embodiment of the present invention.
Figure 11B:
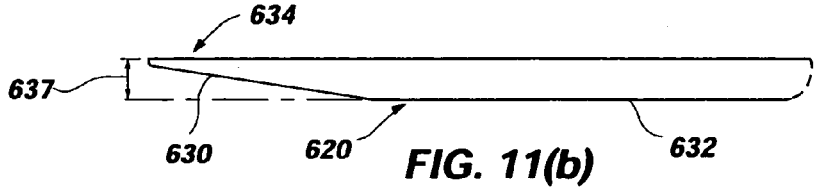

Referring now to FIGS. 11(*a*), 11(*b*), 12(*a*), 12(*b*), 13(*a*), 13(*b*), 14(*a*) and 14(*b*), various embodiments of channels are illustrated in top and side profile views. Referring first to FIGS. 11(*a*) and 11(*b*), a channel 620 can include a tapered portion 630 and a non-tapered constant portion 636 with the air passage 640 defined in the proximal end portion 632 of the channel 620. The constant portion 636 can extend distally from the proximal end portion 632 to the tapered portion 630. The tapered portion 630 can taper distally from the constant portion 636 to a distal end portion 634 of the channel 620. In this manner, the tapered portion 630 extends only partially along the longitudinal length of the channel 620. Also, the tapered portion 630 can taper toward the distal end portion 634 with respect to a depth 637 of the channel 620.

Figure 12A:
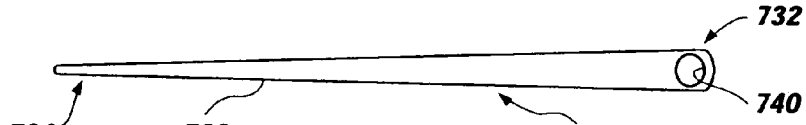
FIGS. 12(*a*) and 12(*b*) illustrate respective top and side profile views of another embodiment of a tapered channel, depicting the tapered channel tapering in width and constant in depth.
Figure 12B:
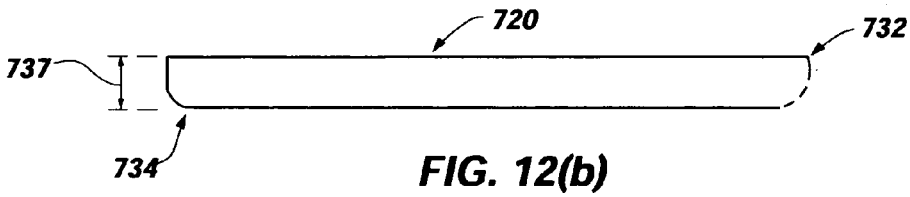

With respect to FIGS. 12(*a*) and 12(*b*), another embodiment of a channel 720 is illustrated in respective top and side profile views. In this embodiment, the channel 720 can include a tapered portion 730, tapering in width and tapering substantially the entire longitudinal length of the channel 720 from the proximal end portion 732 to the distal end portion 734. As in the previous embodiments, the air passage 740 can be disposed at the proximal end portion 737 of the channel 720. Further, in this embodiment, the channel 720 can maintain a substantially constant depth 737 along the longitudinal length of the channel 720.

Figure 13A:
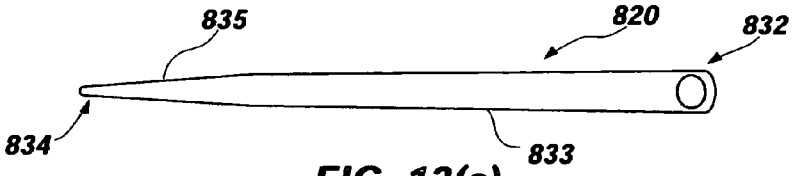
FIGS. 13(*a*) and 13(*b*) illustrate respective top and side profile views of another embodiment of a tapered channel, depicting the tapered channel having a proximal tapered portion and a distal tapered portion each tapering in width and depth.
Figure 13B:
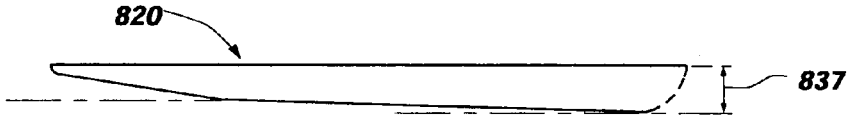

With respect to FIGS. 13(*a*) and 13(*b*), another embodiment of a channel 820 is illustrated in respective top and side profile views. The channel 820 in this embodiment can include multiple tapered portions 830 and, specifically, a proximal tapered portion 833 and a distal tapered portion 835. The proximal tapered portion 833 can be configured to taper distally, in width and/or depth, from the proximal end portion 832 to any suitable length along the longitudinal length of the channel 820. Such a suitable length can be determined by one of ordinary skill in the art. The distal tapered portion 835 can taper from a distal end of the proximal tapered portion 833 to a distal end portion 834 of the channel 820. Such distal tapered portion 835 can taper in width and/or depth along the length thereof.

Figure 14A:
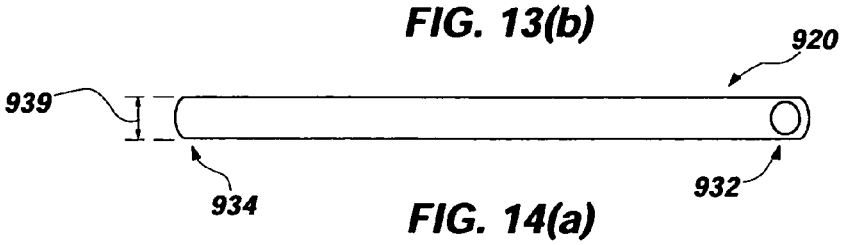
FIGS. 14(*a*) and 14(*b*) illustrate respective top and side profile views of another embodiment of a tapered channel, depicting the tapered channel having a non-tapered constant portion and a tapered portion tapering in depth of the tapered channel.
Figure 14B:
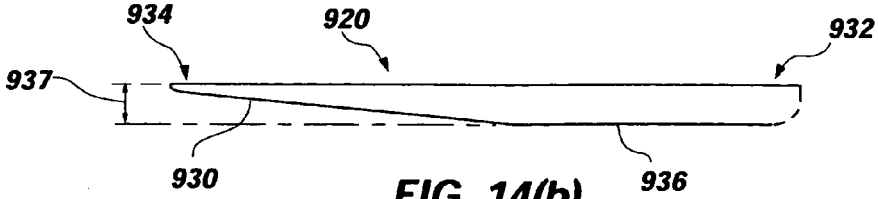

FIGS. 14(*a*) and 14(*b*) illustrate still another embodiment of a channel 920 in respective top and side profile views. In this embodiment, the channel 920 can include a substantially constant width 939, as depicted in the top profile view of FIG. 14(*a*), along the longitudinal length of the channel 920. The tapered portion in this embodiment, however, tapers with respect to a depth 937 of the channel 920, as depicted in FIG. 14(*b*). Specifically, the channel 920 can include a constant portion 936 and a tapered portion 930. The constant portion 936 can extend distally from the proximal end portion 932 of the channel 920 to the tapered portion 930. The tapered portion 930 can taper toward the distal end portion 934 with respect to the depth 937 of the channel 920.

As can be well appreciated by one of ordinary skill in the art, there are numerous modifications and combinations that can be implemented in varying the cross-sectional area of a channel along the length thereof. As such, the present invention is not limited to the above depicted embodiments of channels having tapered portions and can be modified in various configurations to provide similar results to control the suction force applied to a media sheet placed over the contact surface of the platen.

It is to be understood that the above-referenced arrangements are only illustrative of the application for the principles of the present invention. Numerous modifications and alternative arrangements can be devised without departing from the spirit and scope of the present invention while the present invention has been shown in the drawings and fully described above with particularity and detail in connection with what is presently deemed to be the most practical and preferred embodiments(s) of the invention, it will be apparent to those of ordinary skill in the art that numerous modifications can be made without departing from the principles and concepts of the invention as set forth in the claims.

What is claimed is:

1. A platen for supporting a media sheet, comprising:

a contact surface;

a channel defined in the contact surface and extending a length, the channel having a varying cross-sectional area comprising varying a depth and a width of the channel along at least a portion of the length thereof; and an air passage extending from the channel to deliver negative pressure to the channel, wherein the channel has a first end and a second end opposite the first end, wherein the depth of the channel at the second end is less than the depth of the channel at the first end, wherein the width of the channel at the first end is greater than the width of the channel at the second end, and wherein the air passage extends from the first end of the channel.

2. The platen of claim 1, wherein the varying cross-sectional area further comprises a tapered portion in the channel.

3. The platen of claim 2, wherein the tapered portion comprises multiple tapered portions along the length of the channel.

4. The platen of claim 1, wherein the air passage extends from the channel at a tilted orientation configured to reduce friction.

5. The platen of claim 1, further comprising elongated recesses defined in the contact surface and extending transverse from the channel.

6. The platen of claim 1, wherein the channel comprises an array of channels extending substantially parallel to each other.

7. The platen of claim 1, wherein the channel comprises a first array of channels and a second array of channels, the first array of the channels extending substantially parallel to each other and the second array of the channels extending substantially parallel to each other.

8. The platen of claim 7, wherein the air passage comprises first air passages extending from the first array of the channels and second air passages extending from the second array of the channels.

9. The platen of claim 7, wherein at least one of the channels in the first array includes a common longitudinal axis with at least one of the channels in the second array.

10. The platen of claim 9, further comprising a channel interconnecting and longitudinally extending between the at least one of the channels in the first array and the at least one of the channels in the second array having the common longitudinal axis.

11. The platen of claim 7, wherein the channels of the first array are staggered with respect to the channels in the second array.

12. The platen of claim 1, wherein the contact surface is a substantially planar surface.

13. The platen of claim 1, wherein the contact surface is disposed around a cylindrical drum with the channel extending along a longitudinal length of the cylindrical drum.

14. The platen of claim 1, wherein the contact surface is disposed around a cylindrical drum with the channel extending laterally around the cylindrical drum with respect to a longitudinal length of the cylindrical drum.

15. The platen of claim 1, wherein the air passage is confined to the first end of the channel.

16. A printer device configured to support a media sheet, the printer device comprising:

a print engine;

a negative air pressure source; and a platen operatively coupled to the negative air pressure source and disposed adjacent the print engine, the platen including:

a contact surface;

a channel defined in the contact surface and extending a length, the channel having a varying cross-sectional area comprising varying a depth and a width of the channel along at least a portion of the length thereof; and an air passage extending from the channel to the negative air pressure source, wherein the channel has a first end and a second end opposite the first end, wherein the depth of the channel at the second end is less than the depth of the channel at the first end, wherein the width of the channel at the first end is greater than the width of the channel at the second end, and wherein the air passage extends from the first end of the channel.

17. The printer device of claim 16, wherein the varying cross-sectional area further comprises a tapered portion in the channel.

18. The printer device of claim 17, wherein the tapered portion comprises multiple tapered portions along the length of the channel.

19. The printer device of claim 16, wherein the air passage extends from the channel at a tilted orientation configured to reduce friction.

20. The printer device of claim 16, wherein the air passage is confined to the first end of the channel.

21. A method for supporting media in a printer device, the method comprising:

positioning a back surface of a media sheet against a portion of a contact surface of a platen; and establishing negative pressure applied to the media sheet through an air passage extending from a channel defined in the contact surface, including controlling the negative pressure applied to the media sheet to suction the media sheet to the contact surface of the platen by providing the channel with a varying cross-sectional area comprising varying a depth and a width of the channel along at least a portion of a length of the channel, wherein the channel has a first end and a second end opposite the first end, wherein the depth of the channel at the second end is less than the depth of the channel at the first end, wherein the width of the channel at the first end is greater than the width of the channel at the second end, and wherein the air passage extends from the first end of the channel.

22. The method of claim 21, wherein the positioning further comprises positioning the media sheet to leave an exposed channel portion, uncovered by the media sheet, to suction the media sheet to the contact surface of the platen.

23. The method of claim 21, wherein the establishing further comprises controlling the negative pressure applied to the media sheet by providing a tapered portion in the channel.

24. The method of claim 21, wherein the air passage is confined to the first end of the channel.

25. A platen for supporting a media sheet, comprising:

a contact surface;

negative pressure means for delivering negative pressure to the contact surface; and channel means defined in the contact surface for controlling the negative pressure delivered to the contact surface from the negative pressure means over a length of the channel means, the channel means having a varying cross-sectional area comprising a varying depth and a varying width, wherein a depth of the channel means at a second end portion is less than a depth of the channel means at a first end portion, wherein a width of the channel means at the first end portion is greater than a width of the channel means at the second end portion, and wherein the negative pressure is delivered to the first end portion of the channel means.

* * * * *